US011742626B2

(12) United States Patent
Chen et al.

(10) Patent No.: US 11,742,626 B2
(45) Date of Patent: Aug. 29, 2023

(54) ACTIVE CABLE AVOIDING INFLUENCE OF RX POWER CONSUMPTION

(71) Applicant: EverPro Technologies Company Limited, Wuhan (CN)

(72) Inventors: Wengang Chen, Wuhan (CN); Yi Li, Wuhan (CN); Xinliang Zhou, Beijing (CN); Hui Jiang, Beijing (CN)

(73) Assignee: EVERPRO TECHNOLOGIES COMPANY LTD, Wuhan (CN)

( * ) Notice: Subject to any disclaimer, the term of this patent is extended or adjusted under 35 U.S.C. 154(b) by 0 days.

(21) Appl. No.: 17/930,184

(22) Filed: Sep. 7, 2022

(65) Prior Publication Data

US 2023/0155334 A1 May 18, 2023

(30) Foreign Application Priority Data

Nov. 12, 2021 (CN) ..... 2021113388440.4

(51) Int. Cl.
*H01R 31/06* (2006.01)
*H01B 9/00* (2006.01)

(52) U.S. Cl.
CPC ..... *H01R 31/06* (2013.01); *H01B 9/003* (2013.01)

(58) Field of Classification Search
None
See application file for complete search history.

(56) References Cited

U.S. PATENT DOCUMENTS 6,310,286 B1 * 10/2001 Troxel ..... H01B 11/005 174/34
6,793,539 B1 * 9/2004 Lee ..... H01R 31/06 439/701

(Continued)

FOREIGN PATENT DOCUMENTS

CN 2814854 Y * 9/2006
CN 2821911 Y * 9/2006

(Continued)

OTHER PUBLICATIONS

Notification to Grant Patent from corresponding Chinese Application No. 202111338440.4, dated Dec. 17, 2021. English translation attached.

(Continued)

*Primary Examiner* — Binh B Tran
*Assistant Examiner* — Muhammed Azam
(74) *Attorney, Agent, or Firm* — Grossman, Tucker, Perreault & Pfleger, PLLC

(57) ABSTRACT

An active cable avoiding influence of RX power consumption, comprising: the host connection end, the device connection end and the data wire and the auxiliary wire located between them. The auxiliary wire consists of the main power wire and the auxiliary power wire, wherein, the main power wire is used for current transmission between the VBUS of the host and the device; the auxiliary wire, one end of it is located at the host connection end and connected with the main power wire, and another end at the device connection end and is used for supply power to the active component at the device connection end. The active cable disconnects an active module of the device connection end from the VBUS and also arranges the power module between the active component and the auxiliary wire.

14 Claims, 2 Drawing Sheets

(56) References Cited

U.S. PATENT DOCUMENTS

| | | | | |
|---|---|---|---|---|
| 7,607,920 | B1 * | 10/2009 | Chen | H01R 13/6205 439/39 |
| 8,332,664 | B2 | 12/2012 | Farrar | |
| 8,870,598 | B2 | 10/2014 | Qi | |
| 11,334,139 | B1 * | 5/2022 | Vishwakarma | H04L 12/40039 |
| 2004/0023520 | A1 * | 2/2004 | Schriefer | H01R 31/06 439/11 |
| 2004/0085694 | A1 * | 5/2004 | Germagian | A45C 13/02 361/90 |
| 2004/0203275 | A1 * | 10/2004 | Jeansonne | H01R 13/64 439/378 |
| 2005/0009404 | A1 * | 1/2005 | Lee | H01R 31/06 439/638 |
| 2005/0020144 | A1 * | 1/2005 | Lunecki | H01R 13/665 439/761 |
| 2005/0109841 | A1 * | 5/2005 | Ryan | G06F 13/385 235/380 |
| 2005/0138239 | A1 * | 6/2005 | Kasahara | G06F 13/4072 710/33 |
| 2005/0240705 | A1 * | 10/2005 | Novotney | G11B 19/027 710/303 |
| 2007/0220499 | A1 * | 9/2007 | Bannatyne | H01R 13/665 717/140 |
| 2007/0233294 | A1 * | 10/2007 | Holden | G06F 3/162 710/33 |
| 2007/0263703 | A1 * | 11/2007 | Mahaffey | H04B 1/1607 375/142 |
| 2008/0153351 | A1 * | 6/2008 | Chung | H01R 13/6658 439/607.01 |
| 2009/0254771 | A1 * | 10/2009 | So | G06F 1/3215 713/323 |
| 2009/0295327 | A1 * | 12/2009 | McGinley | H01R 13/70 320/111 |
| 2011/0244728 | A1 * | 10/2011 | Chang | H01R 31/06 439/660 |
| 2012/0012358 | A1 * | 1/2012 | Horan | H01B 11/18 174/113 R |
| 2012/0012359 | A1 * | 1/2012 | Horan | H04L 25/0272 174/113 R |
| 2013/0249777 | A1 * | 9/2013 | Olsson | H01R 13/562 174/73.1 |
| 2014/0049904 | A1 * | 2/2014 | Hume | G06F 1/1632 29/874 |
| 2014/0099808 | A1 * | 4/2014 | McClelland | H01R 13/6205 439/153 |
| 2014/0272506 | A1 * | 9/2014 | Kwon | H01M 10/0431 429/94 |
| 2015/0268688 | A1 * | 9/2015 | Leinonen | G06F 13/409 307/147 |
| 2015/0357835 | A1 * | 12/2015 | Naskali | H02J 7/00 307/23 |
| 2016/0321210 | A1 * | 11/2016 | Baterina | G06F 13/385 |
| 2017/0093104 | A1 * | 3/2017 | Powers | H01R 31/065 |
| 2017/0222381 | A1 * | 8/2017 | Shpiro | H02J 3/00 |
| 2017/0293335 | A1 * | 10/2017 | Dunstan | H02J 50/10 |
| 2017/0329386 | A1 * | 11/2017 | Winemiller | G06F 1/324 |
| 2018/0212418 | A1 * | 7/2018 | Golubovic | H01B 9/003 |
| 2019/0296569 | A1 * | 9/2019 | Chen | H02J 7/0045 |

FOREIGN PATENT DOCUMENTS

| | | | | |
|---|---|---|---|---|
| CN | 2842785 | Y | 11/2006 | |
| CN | 101207256 | A * | 6/2008 | H01R 13/6658 |
| CN | 201298648 | Y * | 8/2009 | |
| CN | 201392501 | Y | 1/2010 | |
| CN | 102084556 | A * | 6/2011 | H01R 13/60 |
| CN | 203085207 | U * | 7/2013 | G06F 13/385 |
| CN | 203811289 | U * | 9/2014 | |
| CN | 104733936 | A * | 6/2015 | H01R 13/7137 |
| CN | 104737140 | A * | 6/2015 | G02B 6/42 |
| CN | 104756200 | A | 7/2015 | |
| CN | 104882742 | A * | 9/2015 | |
| CN | 105826782 | A * | 8/2016 | H01R 12/77 |
| CN | 106159613 | A * | 11/2016 | |
| CN | 106374298 | A * | 2/2017 | |
| CN | 106450999 | A * | 2/2017 | H01R 31/06 |
| CN | 108321648 | A * | 7/2018 | H01B 7/40 |
| CN | 108376872 | A * | 8/2018 | H01R 13/58 |
| CN | 108475560 | A * | 8/2018 | H01B 11/00 |
| CN | 109038130 | A * | 12/2018 | |
| CN | 109510045 | A * | 3/2019 | H01R 13/665 |
| CN | 109524169 | A * | 3/2019 | H01B 13/0026 |
| CN | 109687199 | A * | 4/2019 | H01R 13/40 |
| CN | 109687231 | A * | 4/2019 | H01R 13/42 |
| CN | 109994281 | A * | 7/2019 | |
| CN | 209401944 | U * | 9/2019 | H01R 13/665 |
| CN | 210692932 | U * | 6/2020 | |
| CN | 210723605 | U * | 6/2020 | |
| CN | 112086830 | A * | 12/2020 | H01R 13/665 |
| CN | 212725889 | U * | 3/2021 | |
| CN | 113783055 | A * | 12/2021 | |
| DE | 19917352 | A1 * | 10/2000 | H02B 1/202 |
| DE | 102014019263 | A1 * | 7/2015 | G06F 1/26 |
| EP | 2026426 | A2 * | 2/2009 | H01R 13/60 |
| JP | 2002073219 | A | 3/2002 | |
| JP | 2004021993 | A * | 1/2004 | G06F 13/387 |
| JP | 2004054408 | A * | 2/2004 | |
| JP | 2004056909 | A * | 2/2004 | |
| JP | 2004185194 | A * | 7/2004 | |
| JP | 2004241093 | A * | 8/2004 | G06F 1/3221 |
| JP | 6779999 | B2 * | 11/2020 | G06F 1/266 |
| KR | 200326739 | Y1 * | 9/2003 | |
| KR | 20060119671 | A * | 11/2006 | |
| KR | 20090013345 | A * | 2/2009 | |
| KR | 20100015158 | A * | 2/2010 | |
| KR | 20110007632 | A * | 1/2011 | |
| KR | 20120043851 | A * | 5/2012 | |
| KR | 20130074592 | A * | 7/2013 | |
| WO | WO-2012007785 | A1 * | 1/2012 | H04L 25/0272 |
| WO | WO-2012068567 | A1 * | 5/2012 | A61B 5/0002 |
| WO | WO-2014006619 | A1 * | 1/2014 | H02J 7/0054 |
| WO | WO-2016013013 | A1 * | 1/2016 | G05B 15/02 |
| WO | WO-2018137298 | A1 * | 8/2018 | H01R 31/06 |
| WO | WO-2019178158 | A1 * | 9/2019 | G06F 1/26 |

OTHER PUBLICATIONS

Chinese search report from corresponding Chinese Application No. 202111338440.4, dated Dec. 9, 2021. English translation attached.

* cited by examiner

ACTIVE CABLE AVOIDING INFLUENCE OF RX POWER CONSUMPTION

PRIORITY INFORMATION

The Application Claims were submitted to Patent Office of the People's Republic of China on Nov. 12, 2021 and named as an Active Cable Avoiding Influence of RX Power Consumption, with an application No. 202111338440.4. And the priority of the Chinese patent application mentioned above is incorporated herein by reference in its entirety.

FIELD

The present invention relates to the field of the active cable, specifically, to the active cable that avoids influence of RX power consumption on IR-drop and thickness of the active cable.

BACKGROUND

With development of high-speed wireless network, high-speed USB and HD video, such cables as the USB, the HDMI, the DP and the Type C are more and more popular.

Taking the USB as an example, the USB cable is used for connection and communication between a computer and an external device, and for charging of the device and connecting with outside. Generally speaking, it is used for data transmission and charging.

The U promotion group composed of such industry giants as Intel, Microsoft, HP, Texas Instruments, NEC and ST-NXP announced on Nov. 18, 2008 that the USB 3.0 Specification was officially completed and publicly released. A transmission speed that 10 times USB 2.0 and a higher energy-saving efficiency are provided in the standard, which can be widely used in peripherals of PC and consumer electronics products.

As shown in FIG. 1, the USB 3.0 Cable consists of three pairs (i.e., D+, D−, SSTX+, SSTX−, SSRX+, SSRX−) of twisted-pair for data transmission, and one pair (i.e., GND, Vbus) of copper wire for power transmission, wherein, a high-speed signal cable is compatible with USB 2.0, the copper wire has a power supply capacity of 5V 900 mA, namely, 4.5 W, and the USB cable is shown as FIG. 1.

The USB 3.0 Specifications stipulates that any length of the cables can be used only if two requirements are satisfied, namely attenuation requirement of high-speed cable and IR-drop requirement, wherein, loss requirements of the high-speed signal cable are shown as FIG. 2.

Voltage between the VBUS and the GND is within 450 mV at 5V, 900 mA as required by IR-drop. In order to make the cable longer, two requirements mentioned above should be met. An active optical cable (AOC) is currently commercially available, that is, the active component is used to reduce or compensate the attenuation produced during transmission.

Specifically, as shown in FIG. 3, the cable 100 comprising the host connection end 3 to connect the host 1, the device connection end 4 to connect the device 2, and the data wire and the auxiliary wire between the host connection end 3 and the device connection end 4, the auxiliary wire comprising the main power wire 5 and the ground wire 6, wherein, the power cable 5 is used for current transmission between the VBUS. When the cable 100 transmits current (supplying power to the device), the active component 7 located at the host connection end 3 and the device connection end 4 use electricity from the VBUS via the power cable 5, and thus, the current actually transmitted through the VBUS will rise and the IR-drop of the VBUS exceeds the USB 3.0 specification. In order to keep the IR-drop of the VBUS of the active cable within USB 3.0 specification, the copper wire of the VBUS is generally very thick, so that the cable is not soft.

Therefore, the copper wire ensures that the active cable cannot only satisfy with the attenuation requirement of the high-speed signal cable and IR-drop requirement of the cable, but also improve the softness of the cable and experience of end-users when the cable extends has become an urgent problem to be solved in the prior art.

SUMMARY

The present invention is intended to provide an active cable avoiding influence of RX power consumption for satisfaction with the attenuation of wire size and the IR-drop of the cables and reduction of the cable thickness to improve user experience.

To achieve the object, the present invention employs the following technical solution.

An active line avoiding influence of RX power consumption, comprising:

a host connection end to connect the host, a device connection end to connect the device, and a data wire and an auxiliary wire between the host connection end and the device connection end.

The auxiliary power wire consists of the main power wire and the auxiliary power wire.

Wherein, the main power wire is used for current transmission between the VBUS of the host and the device.

One end of the auxiliary power wire is located at the host connection end and connected with the main power wire, and another end of the auxiliary power wire is located at the device connection end to supply power to the active component of the device connection end.

Optionally, the one end of the auxiliary power wire is located at the host connection end and connected with the main power wire. Specifically, one end of the auxiliary power wire is directly connected with the main power wire at the host connection end, or one end of the auxiliary power wire is used for direct connection with the electrode pins of the VBUS of the host connection end, thereby connecting with the main power wire indirectly.

Optionally, the active component in the host connection end is directly connected with the main power wire and takes electricity from the main power wire.

Optionally, the active component in the host connection end is connected with the auxiliary power wire and takes electricity from the auxiliary power wire.

Optionally, the power module is arranged between the auxiliary power wire and the active component of the host connection end and/or the device connection end to satisfy with different voltage requirements.

Optionally, the host connection end and the device connection end is configured to be plugged into the host and the device.

Optionally, the main power wire and the auxiliary power wire are copper cables.

Optionally, the active cable is an USB, an HDMI, an DP, or a Type C cable.

Optionally, the auxiliary wires also include ground wire.

In conclusion, the present invention has following advantages:

1. By disconnecting the active module of the device connection end from the VBUS, and connecting the additional auxiliary power wire from the host connection end to supply power to the active module at the device connection end, so that the active component at the device connection end at this moment does not take electricity from the VBUS at this terminal, and thus, the current transmitted by the VBUS cable is equal to the current absorbed by the device, so that such problems are solved such as the risks of excessive IR-drop of VBUS, unattractive appearance and insufficient softness due to rough VBUS cable.

2. The power module is arranged between the active component and the auxiliary power wire to satisfy with different voltage requirements.

DETAILED DESCRIPTION

Now, the invention will be explained further in combination with the figures and embodiments. It should be understood that the specific embodiments described here are only used for explanation of the present invention instead of limitation. In addition, for easy description, it should be noted that that only the parts related to the invention are shown in the figures rather than the whole structure.

For the active cable, power from outside is required because the active component is used to enhance signals. In general, power is supplied by the VBUS directly. When the VBUS in the cable is transmitting current (supplying power to the device), the current actually transmitted by the VBUS cable will rise due to the current consumed by the active component with addition of power current, thus leading to a risk that IR-drop of VBUS exceeds the specification in the protocol. In the present invention, the VBUS refers to a connector, a plug of various AOC cables or a pin for power supply in the connection terminal.

Figure 1:
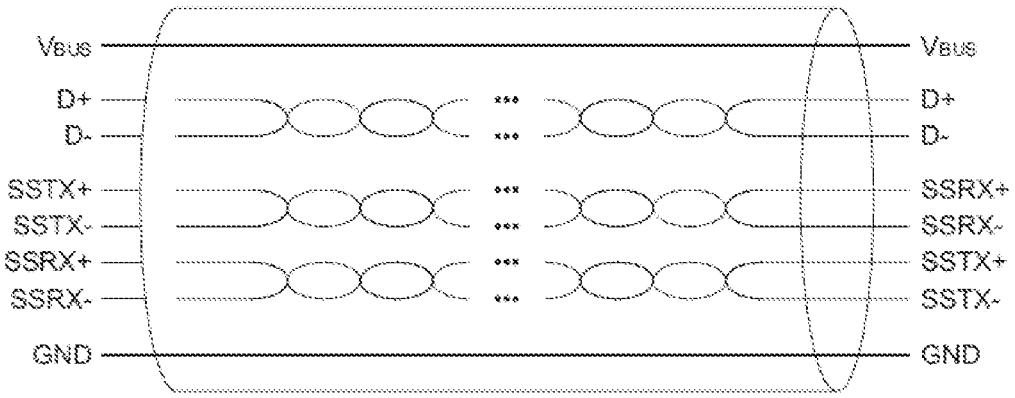
Figure 1 PRIOR ART
FIG. 1 is a schematic diagram of the USB 3.0 cable in existing technology.
Figure 2:
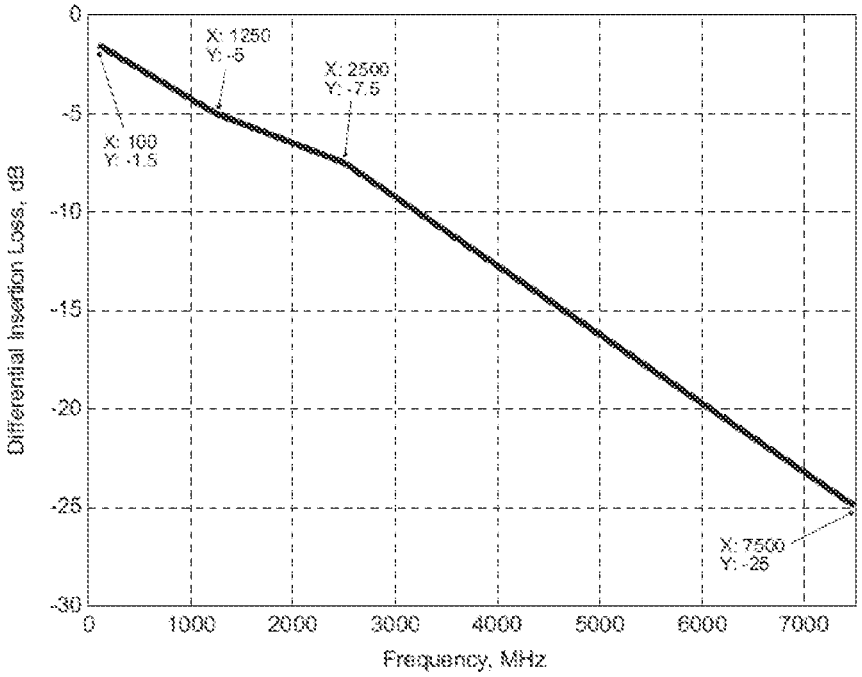
Figure 2 PRIOR ART
FIG. 2 is a schematic diagram of signal attenuation of the USB 3.0 cable in existing technology.
Figure 3:
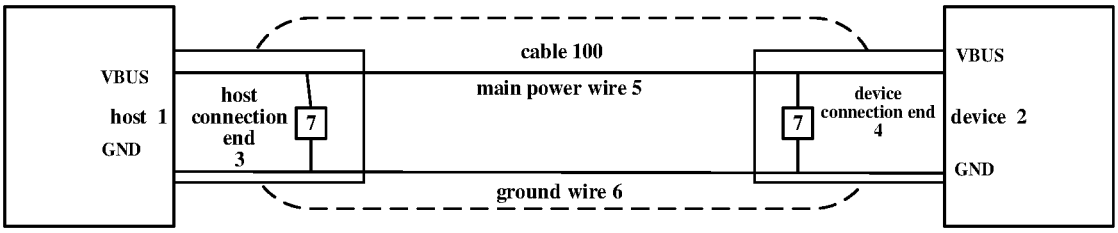
Figure 3 PRIOR ART
FIG. 3 is a module drawing of the USB 3.0 cable in existing technology.
Figure 4:
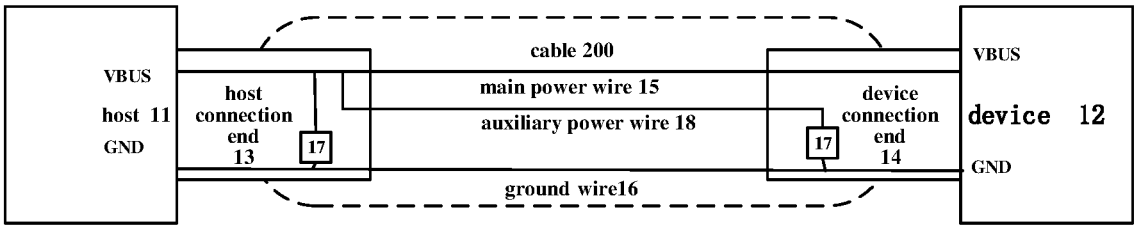
FIG. 4 is a schematic diagram of the active cable avoiding influence of RX power consumption according to an embodiment of the present invention.

The invention is mainly intended to satisfy with cable extension and reduction of thickness of the copper wire, the present invention is mainly intended to disconnect the active component located in the device connection end (RX) from the VBUS at the device connection end and connect one additional auxiliary power wire from the host connection end to supply power to the active component in the device connection end Specifically, FIG. 4 illustrated a schematic diagram of the active cable 200 avoiding influence of RX power consumption according to an embodiment of the present invention, comprising:

The host connection end 13 to connect the host 11, the device connection end 14 to connect device 12, and the data wire and the auxiliary wire between the host connection end 13 and the device connection end 14.

The auxiliary power wire consists of the main power wire 15, the ground wire 16 and the auxiliary power wire 18.

Wherein, the main power wire 15 is used to transmit current between the VBUS of the host 11 and the device 12.

The auxiliary power wire 18, one end of it is located at the host connection end 13 and connected with the main power wire 15, and another end is located at the device connection end 14 to supply power to the active component 17 of the device connection end 14.

Therefore, in the present invention, the active component 17 at the device connection end 14 does not directly take electricity from the VBUS of the device connection end 14, and thus the current transmitted by the VBUS cable is equal to the current absorbed by the device, thereby the problems, such as unattractive appearance of the device caused by too thick cable, are resolved.

One end of the auxiliary power wire 18 in the present invention is connected with the main power wire 15 at the host connection end 13, or one end of the auxiliary power wire 18 is used for direct connection with the electrode pins of the VBUS of the host connection end 13 so as to connect with the main power wire 15 indirectly.

Furthermore, as shown in FIG. 4, the active component 17 at the host connection end 13 is directly connected with the main power wire 15 and takes electricity from the main power wire 15. The transmission current of the main power wire 15 cannot rise because the host connection end 13 is close to the host side and the active component 17 is connected with the main power wire 15 directly.

Figure 5:
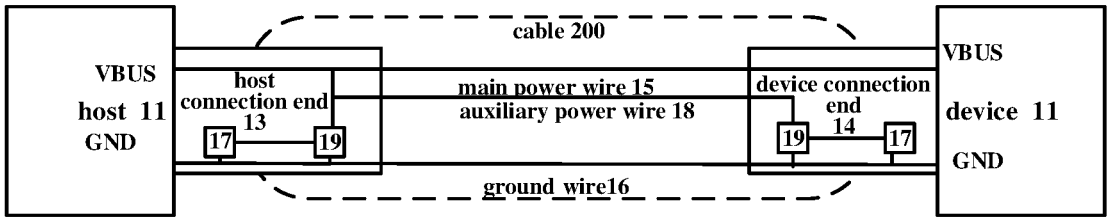
FIG. 5 is a schematic diagram of the active cable avoiding the influence of RX power consumption according to another embodiment of the present invention.

Furthermore, as shown in FIG. 5, the active component 17 in the host connection end 13 is connected with the auxiliary power wire 18, that is, after the auxiliary power wire 18 is connected with main power wire 15, it is connected with the active component 17 of the host connection end 13 and the device connection end 14, respectively.

Furthermore, when adapting to different active components requiring different power voltages, the power module 19 is arranged between the auxiliary power wire 18 and the active component 17 of the host connection end 13 and/or the device connection end 14, thereby satisfying with different voltage requirements.

In the present invention, the host connection end 13 and the device connection end 14 can be the electric socket or other types, as long as they can be plugged into the host 11 and the device 12.

The copper cable can be used as the main power wire and the auxiliary power wire in the present invention.

The active cable can be the USB, the HDMI, the DR, or the Type C cables.

Consequently, the present invention has following advantages:

1. By disconnecting the active module of the device connection end from the VBUS, and connecting the additional auxiliary power wire from the host connection end to supply power to the active module at the device connection end, so that the active component at device connection end at this moment does not take electricity from the VBUS at this terminal, and thus, the current transmitted by the VBUS cable is equal to the current absorbed by the device, resolving the risk of excessive IR-drop of VBUS, unattractive appearance and insufficient softness caused by too tick VBUS cable.
2. The power module is arranged between the active component and the auxiliary power wire to satisfy with different voltage requirements.

The information mentioned above is intended to make further detailed description and illustration for the present invention in combination with recommended embodiments, and it cannot be asserted that the specific embodiments of the present invention are limited to here. For the ordinary persons skilled in the art of the present invention, they can perform a number of simple derivations or replacements without departing from the concept of the present invention, which should be regarded to be in the protection scope as defined by the Claims applied by the present invention.

What is claimed is:

1. An active cable avoiding influence of RX power consumption, comprising:

a host connection end to connect a host, a device connection end to connect a device, and a data wire and auxiliary wires between the host connection end and the device connection end, the auxiliary wires comprising a main power wire and an auxiliary power wire, wherein the main power wire is used to transmit current between VBUS of the host and the device, one end of the auxiliary power wire is located at the host connection end and connected with the main power wire, and another end of the auxiliary power wire is located at the device connection end to supply power to an active component of the device connection end.

2. The active cable according to claim 1, wherein one end of the auxiliary power wire is located at the host connection end, and connected with the main power wire, specifically:

the one end of the auxiliary power wire is directly connected with the main power wire at the host connection end, or one end of the auxiliary power wire is used for direct connection with an electrode pin of the VBUS of the host connection end so as to connect with the main power wire indirectly.

3. The active cable according to claim 2, wherein: an active component in the host connection end is directly connected with the main power wire and takes electricity from the main power wire.

4. The active cable according to claim 2, wherein:

an active component in the host connection end is connected with the auxiliary power wire and takes electricity from the auxiliary power wire.

5. The active cable according to claim 3, wherein:

a power module is arranged between the auxiliary power wire and the active component of the host connection end or the device connection end to satisfy with different voltage requirements.

6. The active cable according to claim 4, wherein:

a power module is arranged between the auxiliary power wire and the active component of the host connection end or the device connection end to satisfy with different voltage requirements.

7. The active cable according to claim 5, wherein:

the host connection end and the device connection end are configured to be plugged into the host and the device.

8. The active cable according to claim 5, wherein:

the main power wire and the auxiliary power wire are copper wires.

9. The active cable according to claim 5, wherein:

the active cable is a USB, an HDMI, a DP, or a Type-C cable.

10. The active cable according to claim 5, wherein:

the auxiliary wires also include a ground wire, one end of the auxiliary power wire is located at the host connection end and connected with the main power wire, and another end is located at the device connection end to supply power to an active component of the device connection end.

11. The active cable according to claim 6, wherein:

the host connection end and the device connection end can be plugged into the host and the device.

12. The active cable according to claim 6, wherein:

the main power wire and the auxiliary power wire are copper wires.

13. The active cable according to claim 6, wherein:

the active cable is a USB, an HDMI, a DP, or a Type-C cable.

14. The active cable according to claim 6, wherein:

the auxiliary wires also include a ground wire, one end of the auxiliary power wire is located at the host connection end and connected with the main power wire, and another end is located at the device connection end to supply power to an active component of the device connection end.

* * * * *